US005156399A

United States Patent [19]

Gauer

[11] Patent Number: 5,156,399

[45] Date of Patent: Oct. 20, 1992

[54] GOLF GLOVE-SUPPORTED GOLF SWING AID

[76] Inventor: Robert Gauer, 19 Sherman Rd., Glen Cove, N.Y. 11542

[21] Appl. No.: 853,589

[22] Filed: Mar. 18, 1992

[51] Int. Cl.[5] ..... A63B 69/36

[52] U.S. Cl. ..... 273/187.2; 273/189 R; 273/DIG. 30; 2/160; 2/161 A

[58] Field of Search ..... 273/183 B, 189 R, DIG. 30, 273/183 D, 183 E, 188 R, 189 R; 2/161 A, 160

[56] References Cited

U.S. PATENT DOCUMENTS

| | | | |
|---|---|---|---|
| 1,169,188 | 1/1916 | Peck | 273/183 B X |
| 4,257,607 | 3/1981 | Nedwick | 273/DIG. 30 |
| 4,643,428 | 2/1987 | Churchill | 273/DIG. 30 |
| 4,781,382 | 11/1988 | Hargraves | 273/183 B |

*Primary Examiner*—George J. Marlo

[57] ABSTRACT

A golf swing and grip aid that extends from between the rear flaps of a golf glove in the view of the golfer while addressing the golf ball, that advantageously uses the coacting hook and loop fastener patches of the glove to achieve its attached relation to cooperating loop and hook fastener patches provided on the body of the aid.

2 Claims, 1 Drawing Sheet

GOLF GLOVE-SUPPORTED GOLF SWING AID

The present invention relates generally to a practice aid for golfers, and more particularly to an improved golf swing aid, the use of which is facilitated by its ready adaptation to a conventional golf glove.

EXAMPLE OF THE PRIOR ART

It is already known according to Zygmund Nedwick U.S. Pat. No. 4,257,607 issued on Mar. 24, 1981 that beneficial instruction can be provided a golfer by using a visual aid that indicates proper execution of the golf swing. The golf swing aid of Nedwick is attached to user's golf glove and during the "address" of the golf ball provides some indication to the golfer concerning alignment with the intended line of flight, which correspondingly assists in the proper execution of the golf swing.

The aforesaid and all other known golf swing aids require special support structure on, for example, the shaft of the golf club or, in the case of Nedwick, on the golf glove of the user. Also, the instruction provided the golfer is limited to alignment, and does not significantly assist in the proper gripping of the golf club.

Broadly, it is an object of the present invention to provide a golf glove-supported or attached golf swing aid overcoming the foregoing and other shortcomings of the prior art. More particularly, the within inventive golf swing aid is cooperatively attached to the user's golf glove without any structural change in the glove, thereby using to advantage the construction of the golf glove for its current intended purpose, and wherein the glove position with the attached golf swing aid also indicates if the golf club is properly gripped, as well as providing other noteworthy advantages and benefits as will be subsequently described in greater detail.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
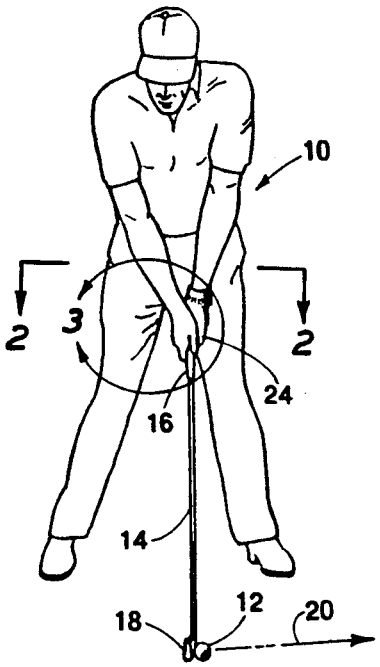
FIG. 1 is a perspective view of a golfer in a position commonly known in golf parlance as "addressing the golf ball" using a golf swing aid according to the present invention.

Shown in FIG. 1 is a golfer, generally designated 10, in a well understood position addressing a golf ball 12, in which the golf club 14 gripped by the golfer, as at 16, has a golf club head 18 perpendicular to the intended line of flight 20.

Shown in greater detail and with more clarity in FIGS. 2–5, is a golf swing aid, generally designated 22, to assist the golfer 10, by visual perspective in the address position of FIG. 1, of ascertaining that the club head 18 is oriented perpendicular to the golf ball 12 so as to provide the line of flight 20, if, of course, the golf ball 12 is properly struck. The golf swing aid 22 thus obviates inadvertent "hooking" or "slicing" due to the club head 18 being unintentionally "closed" or "open" with respect to the intended line of flight 20.

Figure 2:
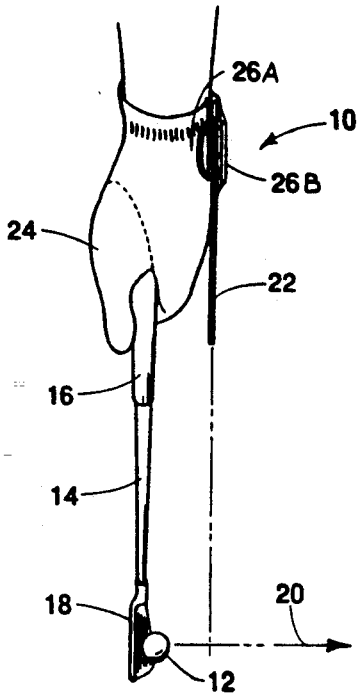
FIG. 2 is a detailed view of what is seen by the golfer of FIG. 1, the line of sight being along line 2—2 of FIG. 1.
Figure 3:
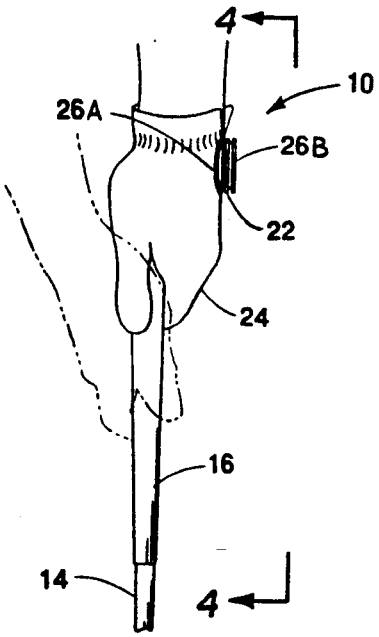
FIG. 3 is a view similar to FIG. 2 but including both hands of the golfer in full line and phantom line perspective.
Figure 4:
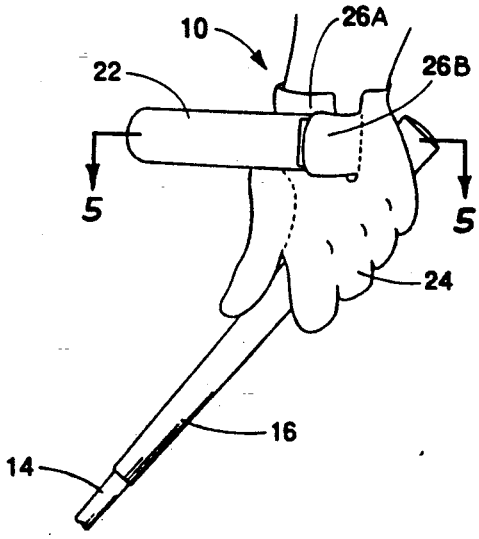
FIG. 4 is a side elevational view as seen along line 4—4 of FIG. 3.

In accordance with the present invention, the golf swing aid 22 is preferably a planar body of plastic construction material, as best shown in FIG. 4 which, as best shown in FIGS. 2 and 3, has an operative position in the golf ball-addressing position (FIG. 1) in which it in effect duplicates the position of the club head 18 in its orientation with regard to the intended line of flight 20. Thus, if the golf swing aid is not perceived as perpendicular to the intended line of flight 20, then this is a visual cue or signal to the golfer 10 that the club head 18 at the distal end of the club 14, and thus not as close as the golf swing aid 22, is also not aligned perpendicular to the intended line of flight 20 and, thus, requires adjustment in position.

Figure 5:
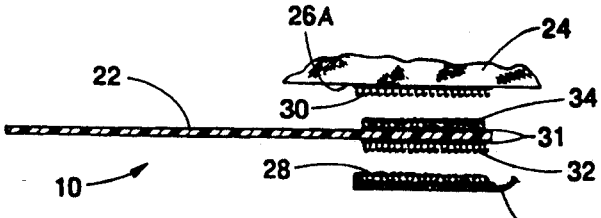
FIG. 5 is an enlarged scale sectional view, in exploded relation, of the velcro patch components of the within golf swing aid as taken along line 5—5 of FIG. 4.

Underlying the present invention is the recognition that the position of the golf swing aid 22 can be readily achieved using a golf glove 24 of current conventional construction. More particularly, glove 24 has a rear closure provided by an underlying glove portion or flap 26A and an overlying flap 26B which, when serving as a closure for the rear of the glove are placed in overlapping relation and held in this position by cooperating VELCRO patches 28 and 30. More particularly, and as best shown in FIG. 5, a VELCRO patch 28 in the specific form of loops is appropriately attached to the flap 26B while the cooperating VELCRO patch 30 in the specific form of hooks is appropriately attached to the other flap 26A. As understood, the "hooks" and the "loops" of the VELCRO patches 28 and 30 are adapted to interengage and hold the flaps 28, 30 in their overlapped position forming a rear closure for the glove 24.

As shown in FIG. 5, an end of the golf swing aid 22 has adhesively secured, as at 31, to its opposite sides a VELCRO patch 32 in the specific form of hooks, and a VELCRO patch 34 in the specific form of loops. Thus, an operative interposed, position of the golf swing aid patches 32 and 34 between the golf glove patches 28 and 30 aligns the hooks with the loops of each and, in a well understood manner, achieves attachment of the golf swing aid 22 in an extending position from between the golf glove flaps 26A and 26B to achieve the alignment function of the club head 18 with the intended line of flight 20 previously described.

It will be understood that for a right handed golfer, the golf glove 24 described above is on the golfer's left hand, or the golf swing leading hand which positions the rear of this hand perpendicular to the intended line of flight 20, assuming, of course, that the golf club handle 16 is properly gripped. For a left handed golfer, the golf glove 24 would be worn on the golfer's right hand and will serve effectively to support the golf swing aid 22 as previously described.

While the glove and attachment herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A golf swing aid for use by a golfer gripping a golf club at the address of a golf ball by said golfer comprising, in combination, a golf glove adapted to be worn on the golf swing leading hand of said golfer in gripping engagement with a golf club handle, said golf glove having rear first and second flaps in overlying relation to the back of said golfer's hand and adapted to overlap each other to form a closure for said glove, said first flap having a patch of loop means and said second flap having a patch of hook means for permitting the joining thereof together to hold said flaps in said overlapping relation, and a golf swing aid consisting of an elongated planar body having opposite ends and having on opposite sides adjacent one end a patch of loop means and on the other side a patch of hook means, said planar body having an operative position disposed with said one end thereof in interposed relation between said first and second glove flaps such that said hooks and loops of said planar body engage with said loops and hooks, respectively, of said flaps so that the unengaged opposite end of said planar body extends from between said flaps in an orientation horizontally forward of the golfer and viewable by the golfer to in effect duplicate the position of the club head relative the intended line of flight of the golf ball and effectively serves as a visual guide to said golfer to making a proper golf swing.

2. The golf swing aid as claimed in claim 1 wherein said patches on said planar body are adhesively secured thereto.

* * * * *